US007296952B2

(12) United States Patent
Cortigiano, Sr.

(10) Patent No.: US 7,296,952 B2
(45) Date of Patent: Nov. 20, 2007

(54) MODULAR TUBE SYSTEM FOR FEEDING SLIDERS TO SLIDER INSERTION DEVICE

(75) Inventor: Ronald Cortigiano, Sr., Toccoa, GA (US)

(73) Assignee: Illinois Tool Works Inc., Glenview, IL (US)

( * ) Notice: Subject to any disclaimer, the term of this patent is extended or adjusted under 35 U.S.C. 154(b) by 69 days.

(21) Appl. No.: 10/930,113

(22) Filed: Aug. 28, 2004

(65) Prior Publication Data

US 2005/0026764 A1 Feb. 3, 2005

Related U.S. Application Data

(62) Division of application No. 10/209,465, filed on Jul. 31, 2002, now Pat. No. 6,796,931.

(51) Int. Cl.
*B65G 51/18* (2006.01)

(52) U.S. Cl. ..... 406/195; 409/191

(58) Field of Classification Search ..... 406/195, 406/191, 192, 193, 194, 196
See application file for complete search history.

(56) References Cited

U.S. PATENT DOCUMENTS 3,956,812 A * 5/1976 Kawakami et al. ..... 193/2 A
4,345,677 A * 8/1982 Shinjo ..... 193/2 A
4,629,054 A * 12/1986 Kondo ..... 198/391
4,770,565 A * 9/1988 Upton ..... 406/19
5,431,760 A * 7/1995 Donovan ..... 156/66
6,047,450 A * 4/2000 Machacek et al. ..... 24/399
6,178,722 B1 1/2001 McMahon ..... 53/412
6,286,189 B1 * 9/2001 Provan et al. ..... 24/30.5 R
6,292,986 B1 * 9/2001 Provan et al. ..... 24/415
6,412,254 B1 * 7/2002 Tilman et al. ..... 53/412
6,418,605 B1 * 7/2002 Kettner ..... 29/408
6,517,473 B1 * 2/2003 Cappel ..... 53/412
6,666,626 B2 * 12/2003 McMahon et al. ..... 406/50
6,796,015 B2 * 9/2004 Cortigiano, Sr. ..... 29/410

* cited by examiner

*Primary Examiner*—Joe Dillon, Jr.
(74) *Attorney, Agent, or Firm*—Ostrager Chong Flaherty & Broitman P.C.

(57) ABSTRACT

A modular slider feeder tube system comprising first and second feeder tubes having respective ends that are coupled by a tube coupling device. Each of the first and second feeder tubes is made of resilient material and comprises a respective channel having a profile that is asymmetric and substantially constant along the lengths of the channels. The tube coupling device also comprises a channel, via which channel the channel of the first feeder tube communicates with the channel of the second feeder tube. Each of the channels maintains the orientation of each slider passing therethrough so that the same end of the slider is always in the lead.

6 Claims, 8 Drawing Sheets

MODULAR TUBE SYSTEM FOR FEEDING SLIDERS TO SLIDER INSERTION DEVICE

RELATED PATENT APPLICATION

This application is a divisional of and claims priority from U.S. patent application Ser. No. 10/209,465 filed on Jul. 31, 2002 now U.S. Pat. No. 6,796,931.

BACKGROUND OF THE INVENTION

This invention generally relates to slider-operated plastic zippers intended for use in reclosable pouches, bags or other packages. In particular, the invention relates to methods and apparatus for feeding sliders to a slider insertion device.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled structures, portions of which form a fulcrum about which the profiled structures may be pivoted out of engagement when lower edges of the bases are forced towards each other.

An improvement in sliders is disclosed in U.S. Pat. No. 6,954,970 entitled "Insertion Apparatus for Attaching Sliders onto Zipper Bags and Film". This slider can be inserted on the zipper so that the zipper is secured in the slider. As a result, during an opening of the reclosable bag the interlocking closure elements of the zipper will not unintentionally re-engage within the slider. For example, a reengagement of the interlocking closure elements could occur when the zipper opening end of the slider is pushed toward a closed zipper park position. Such a re-engagement can occur during operation of the zipper or if the slider is inserted too far from a slider end stop on the zipper. By reducing the possibility of unintentional re-engagement of the interlocking members of the profiles, production of defective bags is reduced. U.S. Pat. No. 6,954,970 discloses a slider insertion apparatus comprising an activator that opens a first portion of a zipper tape, a pusher that inserts the slider onto a second portion of the zipper tape, and a zipper guide that holds a third portion of the zipper tape closed. The zipper guide and the activator with pusher are manufactured to facilitate forward movement of the zipper tape within the slider insertion apparatus; to properly position the profiles of a section of zipper for slider insertion; and to secure an adjacent section of the zipper when the slider is inserted. A loading rack with a supply of sliders may be part of the slider insertion apparatus, with the loading rack being a mechanically attachable device or module.

Systems for transporting sliders to a slider insertion device are disclosed in U.S. Pat. No. 6,666,626 (incorporated by reference herein) entitled "System for Transporting Sliders for Zipper Bags". That application discloses feeding sliders into a slider insertion device by means of a feeder tube that only accepts correctly oriented sliders having an asymmetric profile, i.e., one leg of the slider is longer than the other leg. Sliders are launched into the feeder tube by a sender apparatus that is controlled by a programmable controller based on feedback received by the controller from various sensors that detect the presence or absence of sliders at particular locations in the slider transport system. The sliders are pneumatically transported in predetermined quantities from a supply of sliders, e.g., a vibratory hopper, to a loading rack.

U.S. Pat. No. 6,666,626 discloses embodiments in which sliders are transported via a flexible feeder tube that connects an exit port of the sending apparatus with an entry port of a loading rack mounted to a slider insertion device or of the slider insertion device itself. In the case where a single feeder tube is used, the length of that tube must be selected as a function of the available layout at a particular plant or facility. The length of feeder tube will need to be at least equal to the distance separating the exit port of the slider sender apparatus and the entry port of the slider insertion apparatus, which in turn will depend on placement of those apparatus. The placement of equipment is a function of the location and configuration of the available space and the presence of obstacles or impediments to the feeder tube being laid in a straight line. These factors will vary from plant to plant, making it necessary to customize the feeder tube length for each installation of slider insertion equipment. In particular, measurements will need to be made at the site of installation before the feeder tube is cut and shipped by the equipment vendor.

Moreover, when the automated slider insertion equipment is moved from one location in a plant to another location in the same plant or to a different plant, a length of feeder tube that was suitable for one layout of the equipment may become unsuitable when that equipment is rearranged at a new site where new specifications must be met. If a shorter feeder tube is needed, then of course the existing feeder tube can be cut, but in the case where re-installation or re-configuration of the slider insertion system mandates a longer feeder tube, the existing short feeder tube may be rendered unusable.

In addition, the labor involved in measuring a site where slider insertion equipment is to be installed, calculating the length of the feeder tube required, and then cutting feeder tubing to the calculated length must increase the cost of the equipment. Further, errors in measurement or prediction could give rise to inefficiencies and economic loss.

There is a need for a feeder tube system that can be easily adapted to suit different manufacturing plant circumstances. In particular, there is a need for a slider feeder tube system in which the overall length of the slider feeder tubing can be varied to fit the requirements of any installation.

BRIEF DESCRIPTION OF THE INVENTION

The present invention is directed to a modular slider feeder tube system that can be easily assembled to meet any length requirement. This is accomplished by connecting two or more feeder tubes in a chain to form a conduit of sufficient length. The feeder tubes may be cut to one or more predetermined lengths and stored in inventory. For each installation, a predetermined number of feeder tubes can be shipped and then linked together by the installer at the installation site. The feeder tubes are spliced together using tube coupling devices that also form a part of the invention. The invention is further directed to a method for installing a modular feeder tube system to connect a slider sender apparatus to a slider insertion apparatus.

One aspect of the invention is a tube made of resilient material and comprising a channel that extends from a first opening at one end of the tube to a second opening at the other end of the tube, the first opening having a first profile that is asymmetric and the second opening having a second profile different than the first profile, the area of the second profile being greater than the area of the first profile. The channel comprises two sections, a relatively longer channel section running from the first opening to an intermediate point along the tube length and a relatively shorter channel running from the intermediate point to the second opening. The longer channel section has the first profile along its entire length.

Another aspect of the invention is a tube coupling device comprising an elongated body and first and second clamping plates. The elongated body comprises a central section, a first mandrel projecting from one end of the central section, a second mandrel projecting from the other end of the central section, and a channel of constant profile running through the first and second mandrels and the central section. The first and second clamping plates are fastened to opposing sides of the central section. The first clamping plate comprises a first projection directed toward the first mandrel and a second projection directed toward the second mandrel, while the second clamping plate comprises a third projection directed toward the first mandrel and a fourth projection directed toward the second mandrel.

A further aspect of the invention is a modular feeder tube system comprising first and second feeder tubes having respective ends that are coupled by a tube coupling device. Each of the first and second feeder tubes is made of resilient material and comprises a respective channel having a profile that is asymmetric and substantially constant along the lengths of the channels. The tube coupling device also comprises a channel, via which channel the channel of the first feeder tube communicates with the channel of the second feeder tube. Each of the channels maintains the orientation of each slider passing therethrough so that the same end of the slider is always in the lead.

Yet another aspect of the invention is a method of installing a modular feeder tube system to connect a slider sending apparatus to a slider insertion apparatus, comprising the following steps: (a) coupling first through N-th feeder tubes together in a chain, wherein $N \geqq 2$; (b) coupling an uncoupled end of the first feeder tube to the slider sending apparatus; and (c) coupling an uncoupled end of the N-th feeder tube to the slider insertion apparatus.

A further aspect of the invention is a system comprising: a source of sliders; a slider sender apparatus coupled to receive sliders from the slider source; a modular feeder tube system comprising first through N-th feeder tubes spliced together in a chain, wherein $N \geqq 2$, one end of the first feeder tube being coupled to the slider sender apparatus; and a slider insertion apparatus coupled to one end of the N-th feeder tube. Each of the slider sender apparatus, first through N-th feeder tubes, and slider insertion apparatus comprises a respective channel, the channels being in communication to form a conduit, each of the channels being profiled to maintain the orientation of each slider passing therethrough so that the same end of the slider is always in the lead.

Other aspects of the invention are disclosed and claimed below.

DETAILED DESCRIPTION OF THE INVENTION

Figure 1:
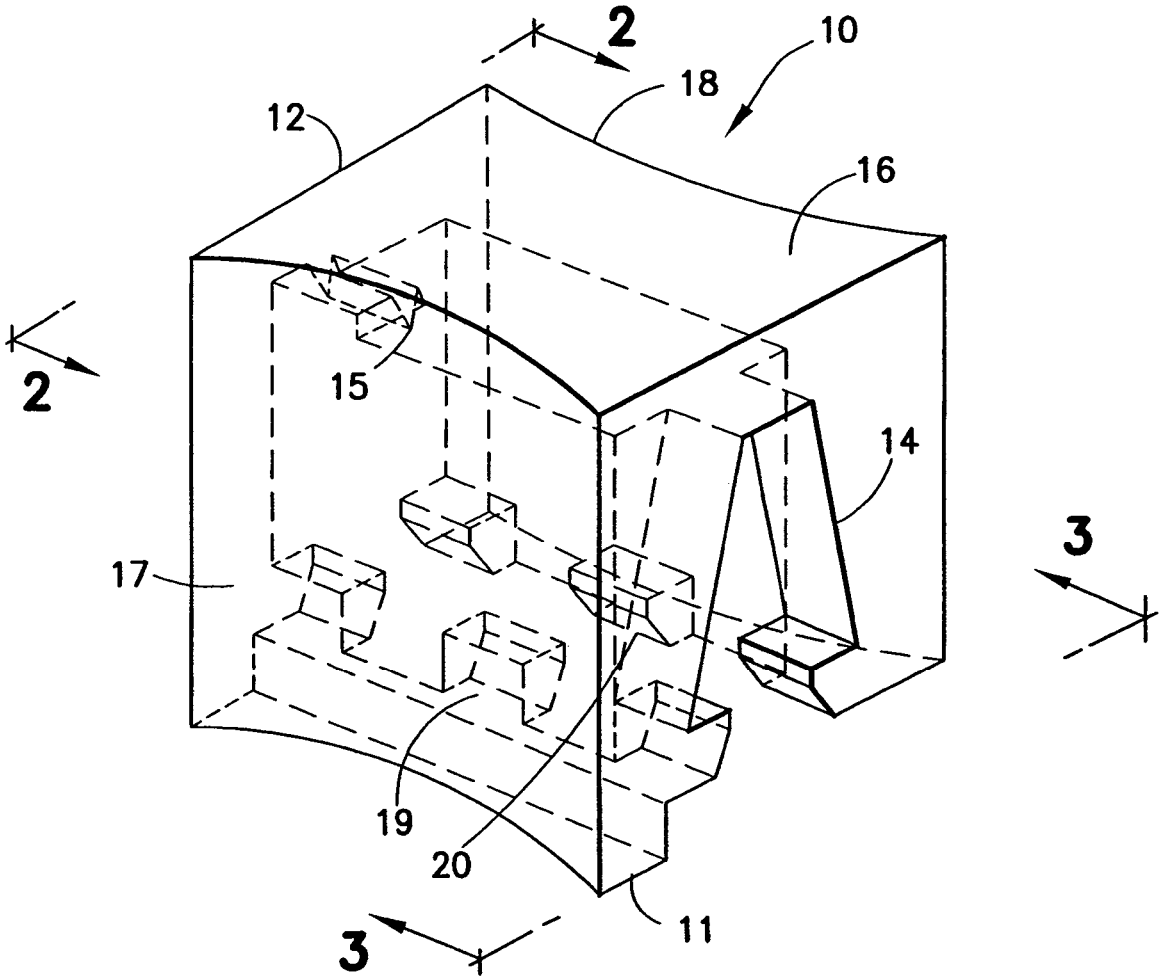
FIG. 1 is a drawing showing an isometric view of one type of slider that can be inserted on a zipper using an automated slider insertion device.

Reference will now be made to the drawings, in which similar elements in different drawings bear the same reference numerals. For the purpose of illustration, the present invention will be described with reference to feeding of a slider of the type depicted in FIG. 1. However, application of the slider feeding system of the present invention is not limited to sliders of the type described below.

The slider 10 shown in FIG. 1 comprises a top wall 16 and opposing side walls or arms 17 and 18 integrally with opposite sides of the top wall 16, forming a channel having a zipper opening end 12 and a zipper closing end 14. A leg 11 projects downward from side wall 17. The slider comprises a keeper 15 extending downward from the top wall 16 and disposed between arms 17 and 18. The slider further comprises a plurality of mutually aligned, longitudinally extending retaining shoulders 19 projecting from the side wall 17, and a plurality of mutually aligned, longitudinally extending retaining shoulders 20 projecting from the side wall 18. The retaining shoulders 19 and 20 are shown as separate; however, the shoulders may be continuous along the length of the slider 10.

Figure 2:
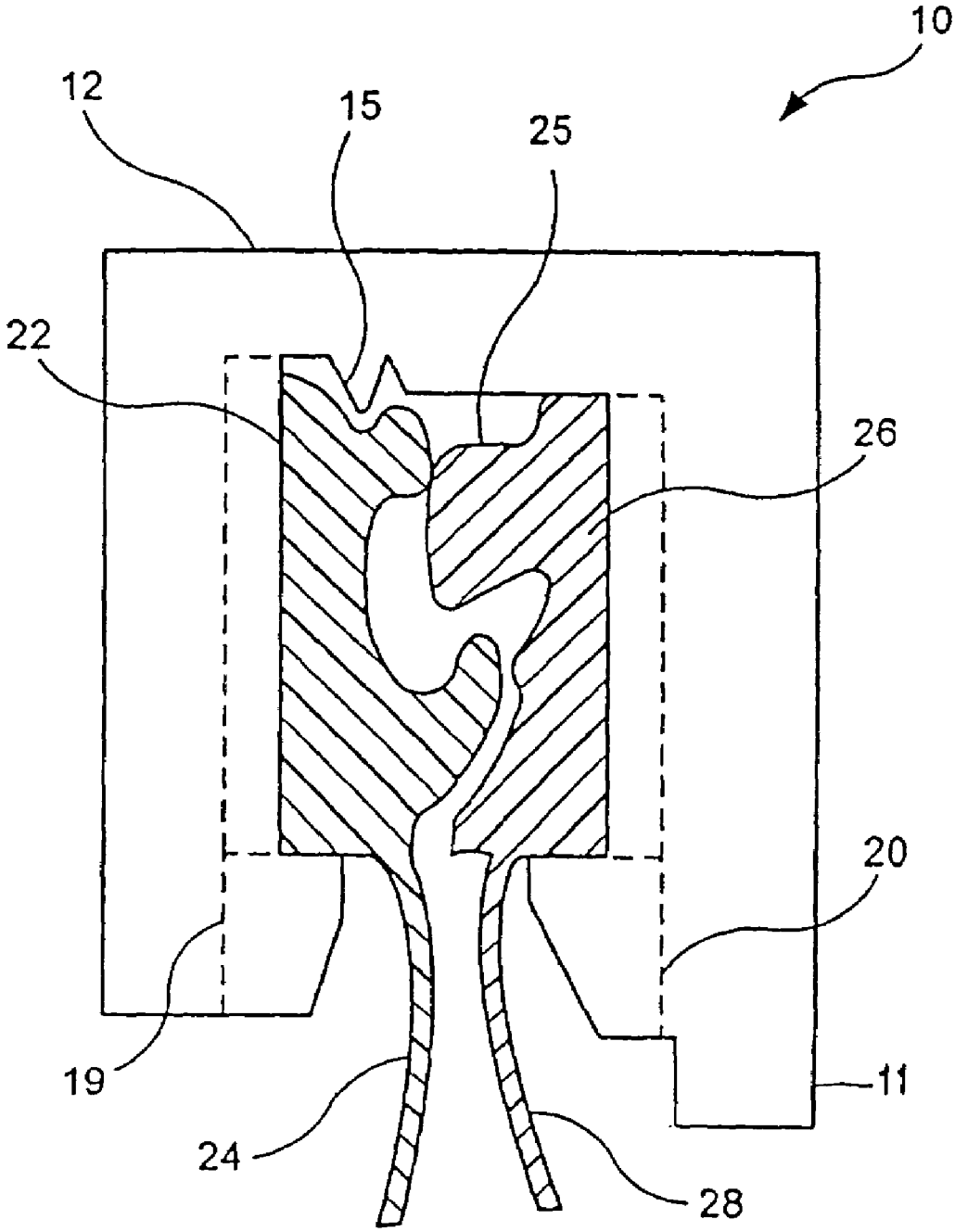
FIGS. 2 and 3 are drawings showing respective end views of the zipper opening end and zipper closing end of the slider depicted in FIG. 1, with the slider shown encompassing a portion of a zipper.

The keeper 15, as well as the retaining shoulders 19 and 20, secure a zipper within the slider 10, as shown in FIG. 2. FIG. 2 is an end view of the zipper opening end of the slider 10 with the slider shown encompassing a portion of a zipper 25 of a type known to those skilled in the art. In the state depicted in FIG. 2, the keeper 15 secures an interlocking member 22 of zipper part or half 24 of zipper 25 by preventing the interlocking member 22 from moving toward the mating interlocking member 26 of zipper part or half 28. If the interlocking members are formed of a sufficiently stiff material, the interlocking member 22 may include a slight recess to accommodate the keeper 15. By preventing movement of the interlocking member 22 towards the interlocking member 26, the zipper parts 24 and 28 always remain partially disengaged at the opening end, thereby reducing the possibility of an unintentional full engagement of the interlocking members within the slider.

Figure 3:
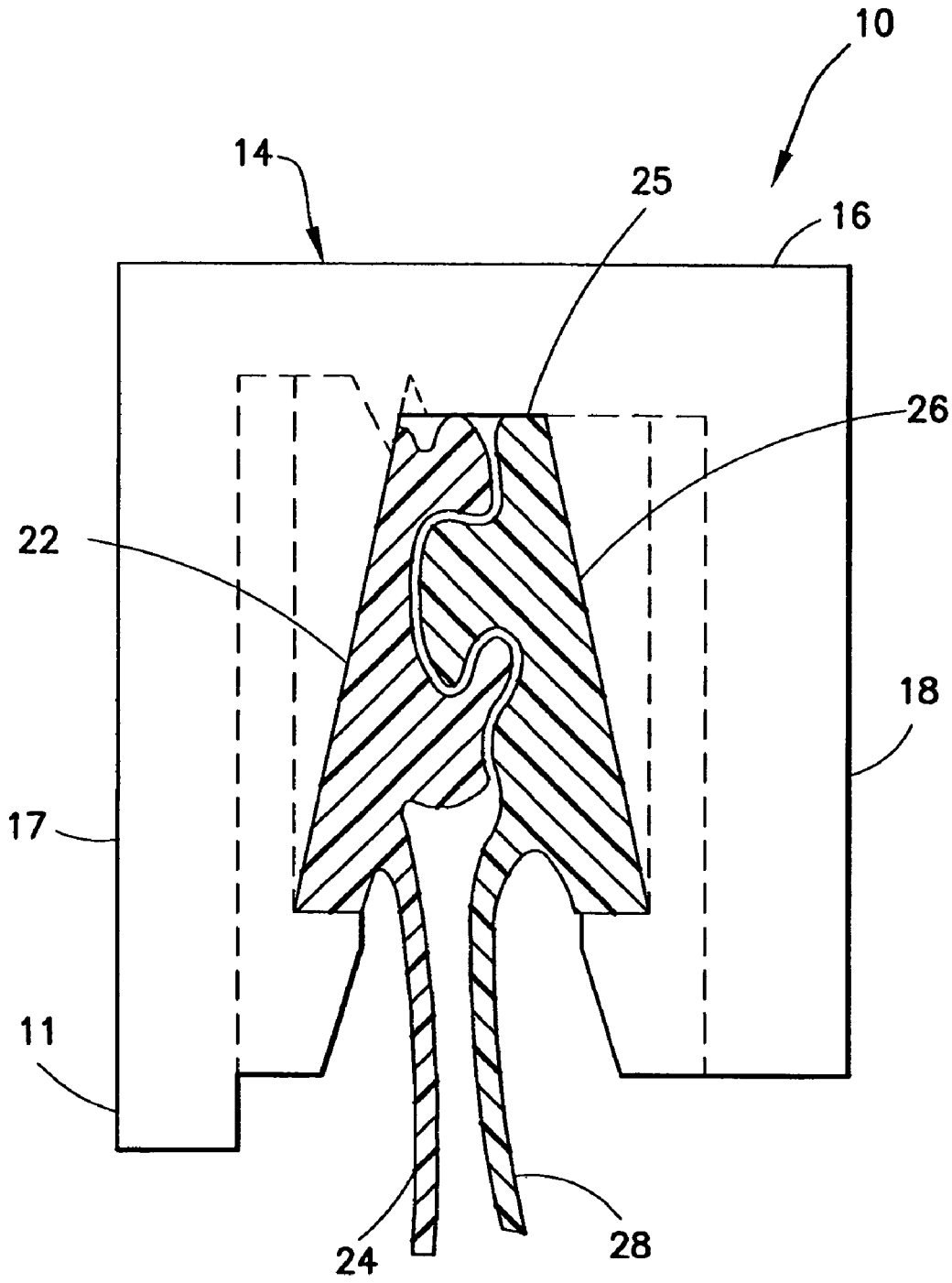

The arms of the slider are designed with interior surfaces having lower portions that converge in a direction from the opening end of the slider to the closing end, and having upper portions that diverge in the same direction. The lower portions on the interior surfaces of the slider arms 17 and 18 press the bottom edges of the interlockable members 22 and 26 toward each other when the slider is moved in the closing direction. These members are designed with surfaces that cooperate to form a fulcrum, about which the interlockable members rotate when their bottom edges are pressed together, causing the zipper portions above the fulcrum point to separate. In particular, the male and female profiles disengage, thereby opening the zipper as seen in FIG. 2. Conversely, when the slider is moved in the opposite or opening direction, the upper portions of the interior surfaces of the slider arms press the upper portions of the interlockable members 22 and 26 together, causing the zipper to close, as seen in FIG. 3.

Figure 4:
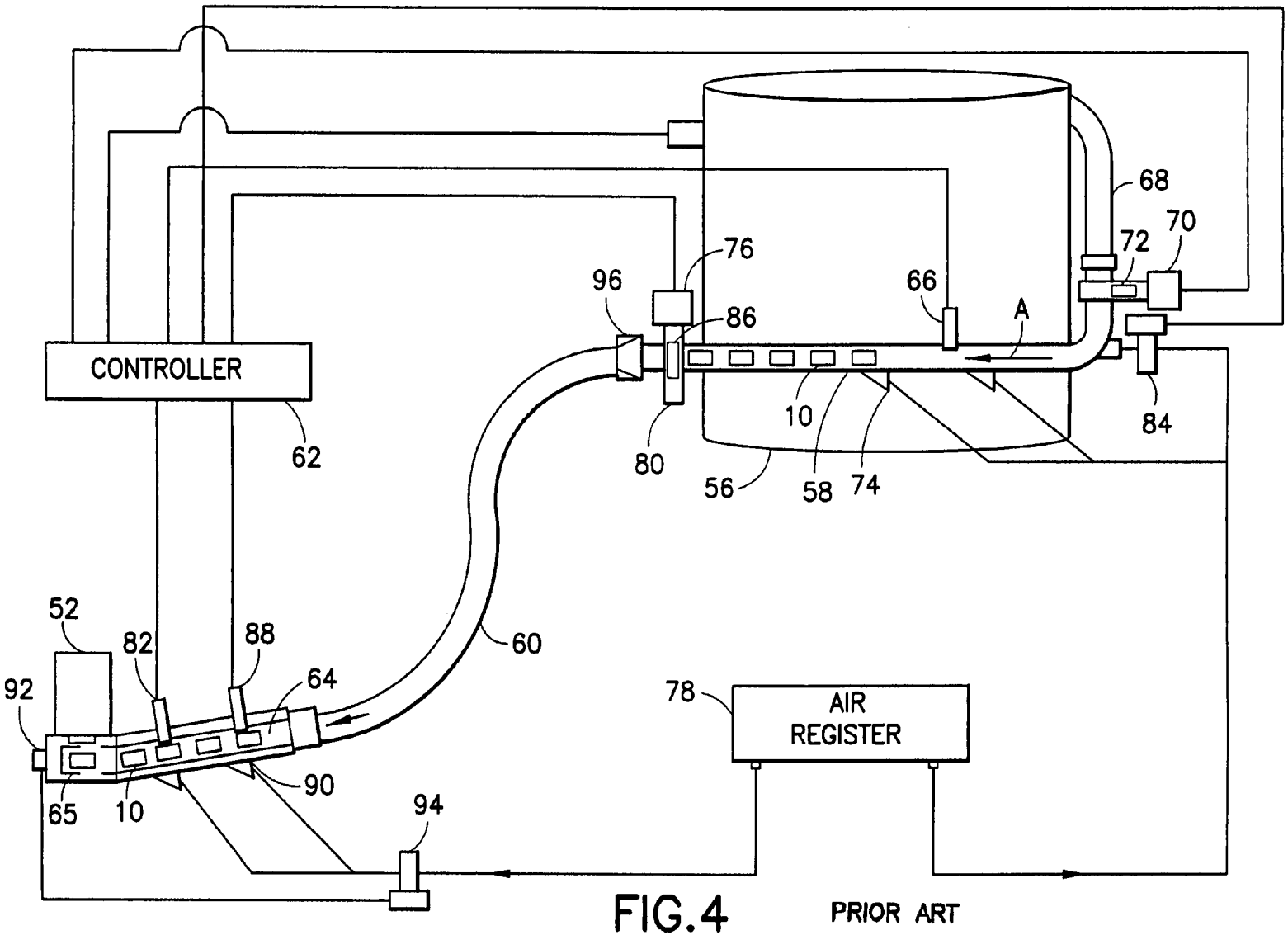
FIG. 4 is a drawing showing an arrangement view of a known slider feeding system for supplying sliders to a slider insertion device.

FIG. 4 is an arrangement view depicting a known slider feed tube and sender apparatus that provides a conduit for supplying sliders from a vibratory bowl 56 to a slider insertion device 52. The apparatus generally includes an elongated sender track 58, a feed tube 60, a programmable controller 62 and an optional loading rack 64. In the slider feeding process, a sensor 66 on the sender track 58 detects the amount of, or a lack of, sliders 10 in the sender track. The sensor 66 signals the controller 62. In response to a signal indicating a shortage of sliders, the controller 62 actuates the vibratory bowl 56 to an operating mode. When operating, the vibratory bowl 56 releases a quantity of sliders 10 from a supply of sliders in the vibratory bowl to a slider entry port 68 of the sender track 58. After the sensor 66 detects that the sender track 58 has a predetermined amount or an adequate quantity of sliders, the controller 62 causes the vibratory bowl 56 to shutdown.

The controller 62 also actuates a solenoid-operated plunger 70 to allow the passage of sliders 10 from the vibratory bowl 56 to the sender track 58 during the operating mode of the vibratory bowl. During the shutdown mode of the vibratory bowl 56, a reciprocating piston 72 of the solenoid-operated plunger 70 blocks the passage of sliders 10 from the vibratory bowl 56 to the sender track 58. The quantity of sliders 10 released to the sender track 58 is pushed along the sender track by directional air connections 74, which pneumatically push the sliders to a slider exit port 76 of the sender track 58. The air connections 74 are fluidly supplied by pressurized air from an air register 78 or any other source of pressurized air.

Still referring to FIG. 4, another solenoid-operated plunger 80 is positioned at the slider exit port 76. Once the sliders 10 are sent to the slider exit port 76, they are ready to be launched into the feeder tube 60. Launching of the sliders 10 is based, at least partly, upon the amount of sliders in the loading rack 64. A sensor 82 at the loading rack 64 detects a lack of sliders 10 in the loading rack or variations in the amount of sliders required in the loading rack. When a lack of sliders 10 or a variation of the required amount of sliders is detected, the sensor 82 signals the controller 62, which actuates the solenoid-operated plunger 80 and a solenoid-operated pneumatic valve 84. Upon actuation, the reciprocating piston 86 of solenoid-operated plunger 80 retracts to open a passage from the sender track 58 to the feeder tube 60. Simultaneously, the pneumatic valve 84 opens to provide an air blast in the sender track 58 upstream of sliders 10 therein. The air blast launches the sliders 10 out of the sender track 58 in the direction indicated by arrow A in FIG. 4. The solenoid-operated plunger 70, in a corollary function, prevents the air-launched sliders 10 from being pushed back into the vibratory bowl 56 by closing the passage back to the vibratory bowl when the pneumatic valve is activated.

The launched sliders 10 pass from the sender track 58 to the feeder tube 60, which is molded with a channel configured to ensure efficient passage of the sliders 10 without jamming during operation. After passage through the feed tube 60, the sliders arrive at the loading rack 64. When a sufficient quantity of sliders 10 is detected in the loading rack 64, the sensor 82 signals the controller 62 to close the pneumatic valve 84 and the solenoid-operated plunger 80. This process repeats itself as the sliders 10 are inserted onto a zipper tape for a reclosable bag by the slider insertion device 52. A sensor 88 is provided as a backup to signal the controller 62 when more sliders 10 are needed in the loading rack 64.

The loading rack 64 guides successive sliders to a slider insertion area 65 of the slider insertion device 52. Similar to the sender track 58, the loading rack 64 is a track that maintains the orientation of the sliders 10. The sliders 10 released to the loading rack 64 are pushed along the rack by directional air connections 90, which pneumatically move the sliders to the slider insertion area 65. The air connections 90 are fluidly supplied by pressurized air from the air register 78 or from any other source of pressurized air. A sensor 92 is provided to detect the presence of a slider 10 in the slider insertion area 65. If a slider is not detected in the slider insertion area 65, the sensor 92 signals a solenoid-operated pneumatic valve 94 to release air into the loading rack 64, thereby moving the next slider into the slider insertion area 65. The loading rack 64 is preferably slanted so that gravity assists the movement of sliders toward the slider insertion area.

The feeder tube 60 is molded from a resilient material to prevent the feeder tube 60 from axially twisting or kinking, thereby allowing the feeder tube to be formed as a curved path. One suitable resilient material is polyurethane rubber (70 durometer). Other moldable resilient materials can also be used. The feeder tube 60 has a channel shaped to maintain the orientation of the sliders passing therethrough. The feeder tube 60 is press-fit and fastened to an attachment piece 96 located at the slider exit port 76 of the sender track 58.

In accordance with one embodiment of the present invention, the single feeder tube shown in FIG. 4 can be replaced by a modular slider feeder tube system. The modular feeder tube system comprising two or more feeder tubes of the type shown in FIG. 5-7, spliced together end to end by means of respective tube coupling devices of the type shown in FIGS. 8 and 9. Each feeder tube is made of resilient material, e.g., polyurethane rubber. For the sake of simplicity and ease of manufacture, each feeder tube preferably has the same length. Any number of feeder tubes can be spliced together to form a conduit of a desired length to meet the requirements of particular installations.

Figure 7:
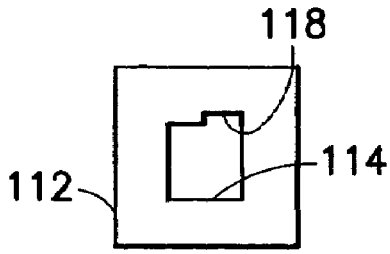

As shown in FIG. 7, each feeder tube 112 has a channel that extends from a first opening at one end of the tube to a second opening at the other end of said tube. The tube channel comprises two sections: a relatively longer channel section 114 running from the first opening to an intermediate point along the tube length and a relatively shorter channel 116 running from the aforementioned intermediate point to the second opening. The length of the longer channel section 114 is on the order of multiple feet (e.g., 8 feet) and the length of said shorter channel section 116 is on the order of the width of the feeder tube, e.g., 1 inch.

The first opening has the six-sided asymmetric profile seen in FIG. 7. The opening at the other end of the tube has the rectangular profile 116 seen in FIG. 6. In the example presented in FIGS. 6 and 7, the profile of channel section 114 is a six-sided polygon with five interior angles each substantially equal to 90 degrees. This six-sided profile generally matches the profile of the slider when viewed from the end. The profile of channel section is designed so that a slider can enter the feeder tube channel only if a certain end of the slider is leading. Then the slider will slide down the channel section 114 on its back, with the projecting leg 11 (see FIGS. 2 and 3) of the slider projecting into the recess 118 that forms part of the channel section 114. The channel section 114 has the six-sided profile seen in FIGS. 6 and 7 along its entire length. Preferably, the channel section 116 has the rectangular profile along its entire length. The outer profile of each feeder tube is rectangular, e.g., square, along the entire length of the tube.

Figure 6:
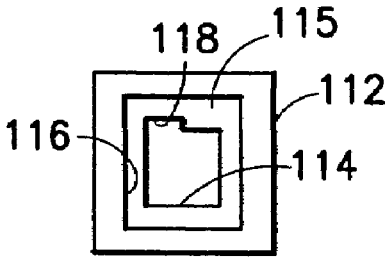

The channel section 116 is offset from channel section 114 and the area of its profile is greater than the area of the profile of channel section 114, as seen in FIG. 6. The profile of channel section 116 is shaped to receive the tapered end of a feeder tube connector or a tube coupling device of the types to be described in detail below. At the intermediate point where the channel section 114 and 116 meet, the feeder tube has a planar internal surface 115 lying between inner and outer closed boundaries. The inner boundary is the junction of channel section 114 and surface 115, while the outer closed boundary is the junction of channel section 116 and surface 115.

Figure 5:
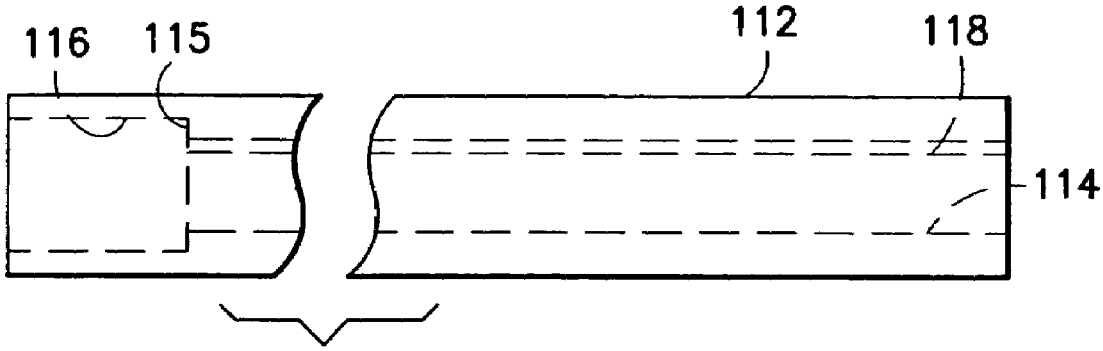
FIGS. 5-7 are drawings showing three views of a flexible tube for feeding sliders in accordance with one embodiment of the present invention.
Figure 8:
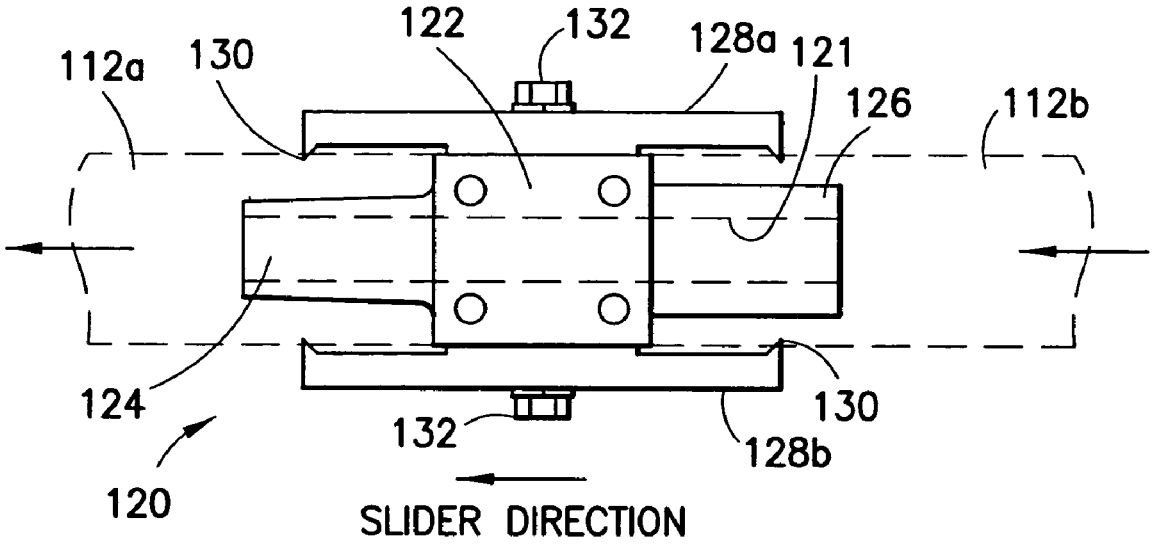
FIGS. 8 and 9 are drawings showing two views of a tube coupling device in accordance with another embodiment of the invention.
Figure 9:
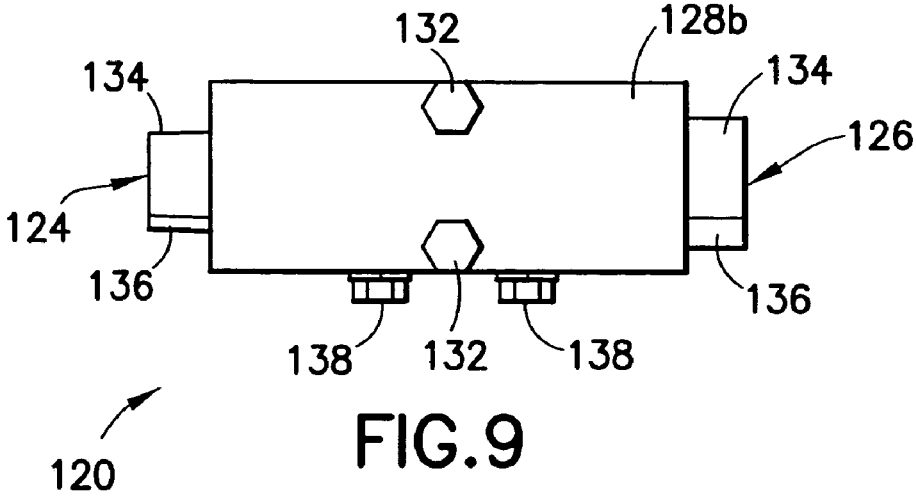

Two feeder tubes of the type shown in FIG. 5 can be spliced together, end to end, by the tube coupling device 120 depicted in FIGS. 8 and 9. Referring to FIG. 8, the tube coupling device 120 comprises an elongated body and a pair of clamping plates 128*a* and 128*b*. The elongated body comprises a central section 122, a first mandrel 124 projecting from one end of central section 122, a second mandrel 126 projecting from the other end of central section 122, and a channel 121 of constant profile running through mandrels 124, 126 and central section 122. The profile of channel 121 is the same as the profile of the channel section 114 (shown in FIGS. 6 and 7) of each feeder tube. The mandrel 126 is wider and taller than the mandrel 124 and is press-fitted into the slider exit end (channel section 116 in FIG. 5) of a feeder tube 112*b* (indicated by dashed lines in FIG. 8). The mandrel 124 is press-fitted into the slider insertion end (channel section 114 in FIG. 5) of another feeder tube 112*a*. Both mandrels are tapered, mandrel 124 in two mutually perpendicular planes, and mandrel 126 in only one plane, to facilitate a tight fit in the feeder tube channels. The result is that the long channel sections 114 of two feeder tubes 112*a* and 112*b* are linked by channel 121 of the tube coupling device 114, providing a continuous conduit that sliders can slide along on their way to the slider insertion device from a slider supply source. The direction of slider travel is indicated by arrows in FIG. 8.

Because the end of the slider guide channel (item 114 in FIG. 5) of the feeder tube that delivers the slider to the tube coupling device 114 is not expanded by mandrel 126 of the tube coupling device, the slider can make a smooth transition from the slider guide channel to the tube coupling channel 121 without snagging on an edge at the entrance to channel 121. Although insertion of the other mandrel 124 in the receiving end of the slider guide channel of feeder tube 112*a* does expand the slider guide channel adjacent the exit to channel 121, the gradual curvature of the expanded slider guide channel of the feeder tube poses no sharp corner or other impediment on which the slider could snag or jam.

As seen in FIG. 8, the ends of the feeder tubes are clamped to the respective mandrels by the clamping plates. The clamping plates 128*a* and 128*b* are fastened to opposing sides of the central section 122 by means of fasteners 132. Each clamping plate comprises projections 130 directed respectively toward mandrels 124 and 126, the projections on clamping plate 128*a* opposing the respective projections on clamping plate 128*b*. The projections 130 grip the ends of the resilient feeder tubes when the clamping plates are fastened to the central section 122.

The central section 122 of the tube coupling device and the mandrels 124, 126 are integrally formed in two parts: a base 134 and a cover 136. The base 134 comprises a longitudinal recess that is covered by the cover 136 to form the channel 121. The recess in the channel 121 for the projecting leg of the slider is formed in the base 134. The channel 121 has a constant profile along its entire length, that profile being the same as the profile of channel section 114 of the feeder tube (see FIG. 7), namely, a six-sided polygon with five interior angles each substantially equal to 90 degrees.

The above-described tube coupling devices can be used to splice first through N-th feeder tubes together in a chain, wherein $N \geqq 2$, one end of the first feeder tube being coupled to a slider sender apparatus, and a slider insertion apparatus being coupled to one end of the N-th feeder tube. Each of the slider sender apparatus, first through N-th feeder tubes, and slider insertion apparatus comprises a respective channel, the channels being in communication to form a conduit, each of the channels being profiled to maintain the orientation of each slider passing therethrough so that the same end of the slider is always in the lead. Thus sliders can be transported in succession from a source of slider, e.g., a vibratory hopper, to a slider insertion device.

Figure 10:
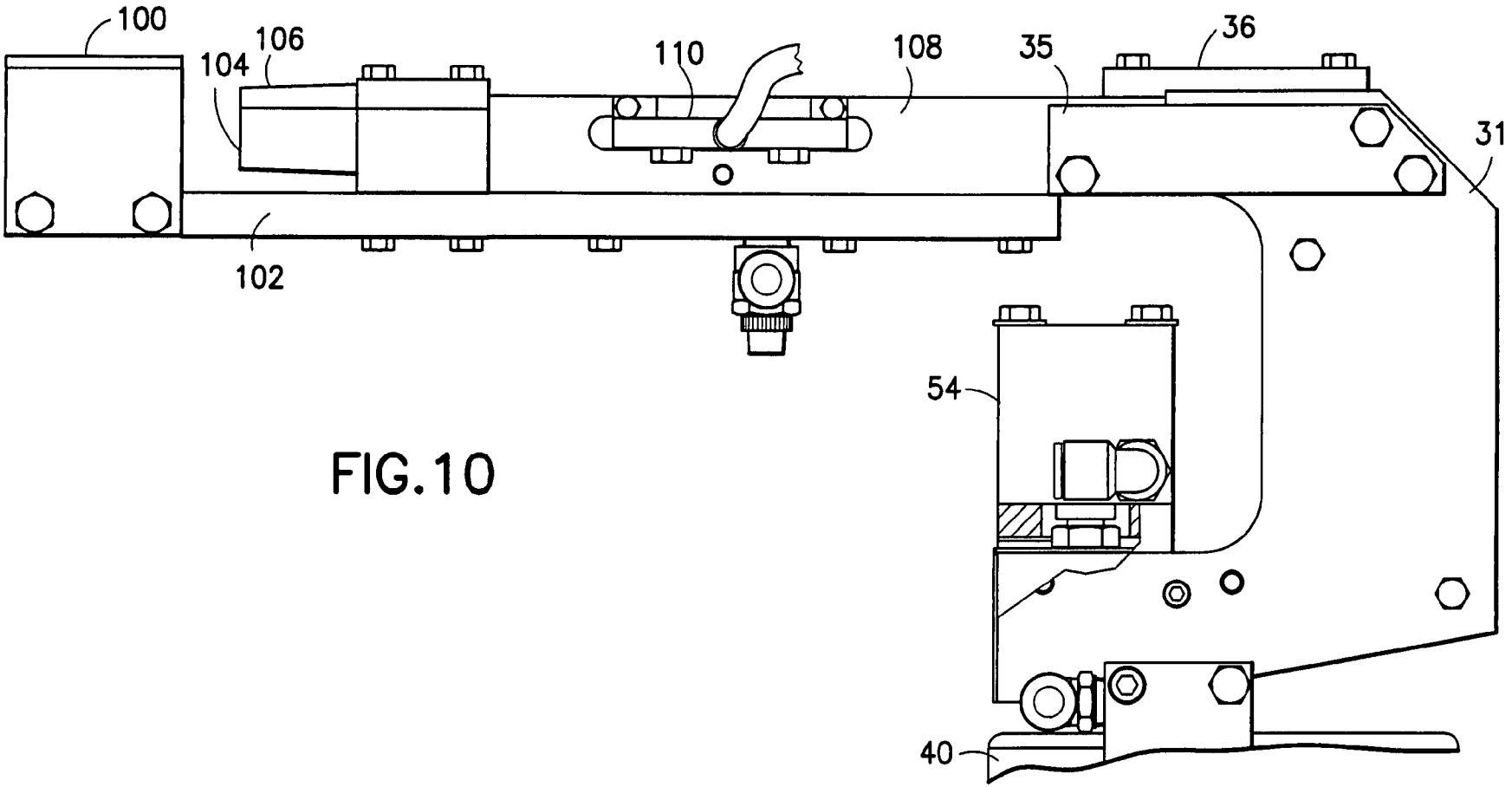
FIGS. 10 and 11 are drawings showing bottom and top views, respectively, of portions of a slider insertion apparatus.
Figure 11:
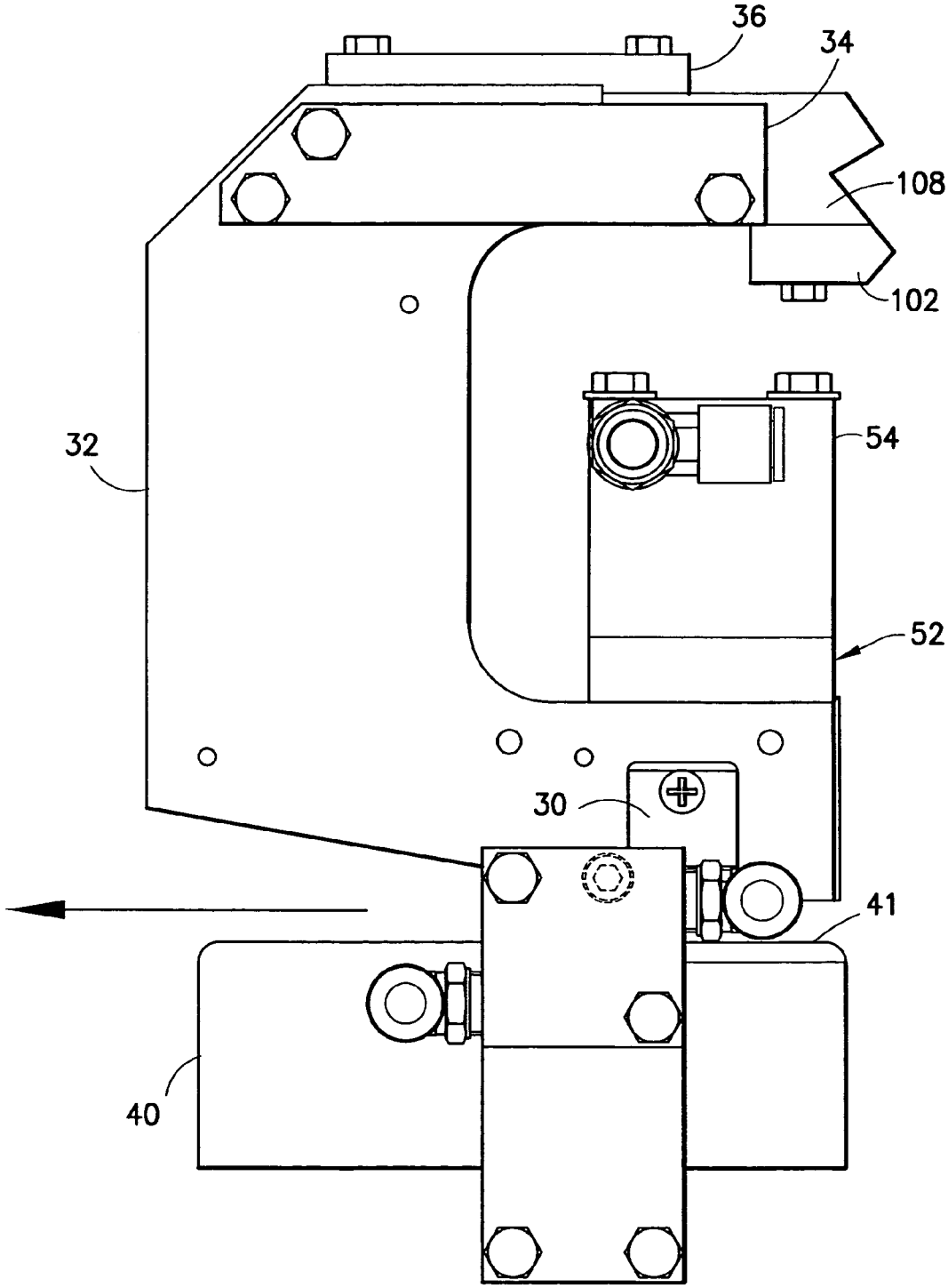

One type of slider insertion device that can receive sliders via the modular feeder tube system disclosed herein is depicted in FIGS. 10 and 11. FIG. 10 is a bottom view showing portions of the slider insertion apparatus from a slider entry point to a slider insertion area at the terminus of a U-shaped slider base; FIG. 11 is a top view of some of the same parts, such as the U-shaped slider base, plus other parts not visible in FIG. 10, such as the zipper guide.

The slider base comprises a U-shaped lower slider base 31 (seen in FIG. 10) and an upper slider base 32 (seen in FIG. 11), which are fastened together to form a U-shaped channel that reverses the orientation of the sliders to be inserted during their transit along the channel. The slider base 31/32 is connected to an air jet rail 108 by means of a pair of splice plates 34 (seen in FIG. 6) and 35 (seen in FIG. 5) and a support plate 36. The numeral 102 designates a cover for the air jet rail 108. The air jet rail 108 has a channel for sliders that is aligned and in communication with an entry end of the U-shaped channel. A jet of air, produced by means previously described, propels the sliders along the air jet rail and toward the slider base.

The air jet rail 108 is in turn connected to a feeder tube connector 104 having a connector cap 106. The feeder tube connector 104 has a channel for sliders that is aligned and in communication with the channel of the air jet rail. The end of a feeder tube of the type shown in FIG. 5 can be press-fitted onto the feeder tube connector 104 in the same manner as previously described in connection with mandrel 126 (shown in FIG. 8) of the tube coupling device. The connector 104 has substantially the same geometry and dimensions as mandrel 126 has. (Conversely, the attachment piece at the exit port of the slider sender apparatus has the same geometry and dimensions as those of mandrel 124 of the tube coupling device 120.) When a feeder tube is connected to the feeder tube connector 104, the channel of the feeder tube communicates with the channel inside the feeder tube connector.

Referring again to FIG. 10, sliders originating at the vibratory hopper (not shown) travel, in succession, through the feeder tube (not shown in FIG. 10, the feeder tube connector 104, the air jet rail 108, and the slider base formed by parts 31 and 32. The lead slider is stopped at the pre-insertion position when its leading end abuts an activating fork (not shown). Each successive slider takes its place at the end of the line of sliders, which line can extend all the way back to optical sensors supported by a pair of sensor mounts 110, only one of which is visible in FIG. 10, along the air jet rail 108. If the sensors detect the absence of a slider at the monitored location in the air jet rail, a signal is produced to a programmable controller that results in more sliders being supplied from the vibratory hopper in a manner disclosed in the aforementioned U.S. patent application Ser. No. 10/106,687. If a slider is detected at the monitored position, then no new sliders are supplied.

The slider insertion operation will now be briefly described with reference to FIG. 11. When the slider arrives at a pre-insertion position under the activator with pusher 52, a capture spring 30 holds the correctly oriented slider in place. During subsequent slider insertion, the pusher (not shown) will push the slider toward a stationary zipper tape with sufficient force to overcome the holding force being applied by the capture spring. The activator with pusher 52 is moved from a retracted position to an extended position by an air cylinder 54 for inserting a slider onto an underlying section of the zipper tape.

In addition to the slider being correctly positioned prior to insertion, the zipper tape must also be correctly positioned and supported in that correct position during slider insertion. In the automated slider insertion apparatus depicted in FIG. 11, the zipper tape is threaded over a saddle 40 comprising an elongated upright plate. The saddle 40 has a straight contact edge 41. The zipper tape sits against contact edge 41 during slider insertion and slides along edge 41 during zipper tape advancement. The saddle 40 is flanked by the extension flanges (not shown) of the interlocked halves of the zipper tape, while the underbelly of an opposing section of the zipper tape sits against the contact edge 41 of the saddle 40. Means (not shown) are provided for gripping the zipper tape in an area adjacent the slider insertion zone, thereby holding the zipper tape closed as a slider is clipped onto the zipper tape by the aforementioned pusher.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The invention claimed is:

1. A modular feeder tube system for pneumatically feeding sliders, comprising first and second feeder tubes having respective ends that are coupled by a tube coupling device, each of said first and second feeder tubes being made of resilient material and comprising a respective channel having a profile, said profile being asymmetric and substantially constant along the lengths of said channels, and said tube coupling device comprising a channel, said channel of said first feeder tube communicating with said channel of said second feeder tube via said channel of said tube coupling device, wherein each of said channels maintains the orientation of each slider passing therethrough so that the same end of the slider is always in the lead, wherein each of said first and second feeder tubes has the same length.

2. The system as recited in claim 1, wherein said channel of said tube coupling device has said profile along its length.

3. The system as recited in claim 1, wherein said profile is a six-sided polygon with five interior angles each substantially equal to 90 degrees.

4. A modular feeder tube system for pneumatically feeding sliders, comprising first and second feeder tubes having respective ends that are coupled by a tube coupling device, each of said first and second feeder tubes being made of resilient material and comprising a respective channel having a first profile, said first profile being asymmetric and substantially constant along the lengths of said channels, and said tube coupling device comprising a channel, said channel of said first feeder tube communicating with said channel of said second feeder tube via said channel of said tube coupling device, wherein each of said channels maintains the orientation of each slider passing therethrough so that the same end of the slider is always in the lead, wherein each of said first and second feeder tubes comprises a respective recess that is in communication with said respective channel, said channel running from a first opening at one end of each feeder tube to an intermediate point along said tube length and said recess running from said intermediate point to a second opening at the other end of each feeder tube, said first opening having said first profile and said second opening having a second profile different than said first profile, the area of said second profile being greater than the area of said first profile, and wherein said tube coupling device comprises first and second mandrels projecting in opposite directions, said first mandrel being press-fit into said channel of said first feeder tube via said first opening of said first feeder tube and said second mandrel being press-fit into said recess of said second feeder tube via said second opening of said second feeder tube, said second mandrel fitting inside said recess of said second feeder tube without causing substantial expansion of said channel of said second feeder tube adjacent said recess.

5. A modular feeder tube system for pneumatically feeding sliders, comprising first and second feeder tubes having respective ends that are coupled by a tube coupling device, each of said first and second feeder tubes being made of resilient material and comprising a respective channel having a profile, said profile being asymmetric and substantially constant along the lengths of said channels, and said tube coupling device comprising a channel, said channel of said first feeder tube communicating with said channel of said second feeder tube via said channel of said tube coupling device, wherein each of said channels maintains the orientation of each slider passing therethrough so that the same end of the slider is always in the lead, wherein said tube coupling device comprises an elongated body and first and second clamping plates arranged to clamp said first and second feeder tubes to said elongated body, said channel of said tube coupling device extending from one end of said elongated body to the other end of said elongated body.

6. The system as recited in claim 5, wherein said elongated body comprises a base and a cover fastened together, said base comprising a longitudinal recess that is covered by said cover to form said channel of said tube coupling device.

* * * * *